United States Patent [19]

Montgomery, Jr. et al.

[11] 4,127,000

[45] Nov. 28, 1978

[54] METHOD AND APPARATUS FOR INSTALLING CHEMICAL ANCHOR BOLT ASSEMBLIES IN EARTH FORMATIONS

[75] Inventors: Robert H. Montgomery, Jr., Fishertown; Raymond D. Evans, Jr., Bedford, both of Pa.

[73] Assignee: Kennametal Inc., Latrobe, Pa.

[21] Appl. No.: 765,972

[22] Filed: Feb. 7, 1977

[51] Int. Cl.[2] ..... E21D 21/00; B25B 13/48

[52] U.S. Cl. ..... 405/261; 81/125

[58] Field of Search ..... 61/45 B, 63; 81/125, 81/121 R, 55, 53.2; 52/698

[56] References Cited

U.S. PATENT DOCUMENTS

| | | | |
|---|---|---|---|
| 3,413,876 | 12/1968 | Shinn | 81/53.2 |
| 3,916,734 | 4/1975 | Sawan | 81/55 |
| 3,935,760 | 2/1976 | Taylor | 81/55 |
| 3,940,941 | 3/1976 | Libert et al. | 61/45 B |
| 3,979,918 | 9/1976 | Vidler | 61/45 B |
| 4,048,875 | 9/1977 | Heinen et al. | 61/45 B |

*Primary Examiner*—Mervin Stein
*Assistant Examiner*—Alex Grosz
*Attorney, Agent, or Firm*—Lawrence R. Burns

[57] ABSTRACT

A method and apparatus for installing chemical anchor bolt assemblies in earth formations comprising the step of abutting the end of the anchor bolt protruding from the earth formation with a predetermined force such that turning of the nut on the end of the anchor bolt will cause the anchor bolt to turn in the hole formation.

7 Claims, 7 Drawing Figures

METHOD AND APPARATUS FOR INSTALLING CHEMICAL ANCHOR BOLT ASSEMBLIES IN EARTH FORMATIONS

BACKGROUND OF THE INVENTION

Chemical anchor bolt assemblies are used in supporting earth formations and are especially useful in providing roof supports in mining operations. Such roof supports are usually installed by drilling a hole upward in the roof of a mine. When the hole has been formed, chemical packets or containers of chemical anchor resin are placed in the hole formation.

A roof or anchor bolt is then inserted upward in the hole formation. The roof or anchor bolt is provided on the lower end with at least a plate and a nut such that the anchor bolt may be inserted upward in the hole formation until the plate and nut abut the roof of the mine.

The bolt assembly is then rotated such that the containers of the chemical anchor resin will be broken and mixed together. The resin is then allowed to harden in the hole formation until it rigidly secures the anchor bolt in the mine roof. The nut on the lower end of the anchor bolt is then torqued to a desired torque level.

One of the problems associated with installing such an anchor bolt in the roof of a mine is that the mine worker must usually use two separate tools. The first tool used must nonrotatably hold the bolt and nut such that it rotates the bolt in the hole to mix the chemical anchor resin.

When the resin has set, it is then usually necessary to change tools such that a second tool then grips and torques the nut on the lower end of the bolt assembly. For obvious reasons, it is not desirous for a machine operator to have to continually change tools on the machine for each step and, further, it is not desirous for the machine operator to have to keep track of a second tool working under conditions normally found in mining operations.

Recently, some advances have been made in the prior art as evidenced by U.S. Pat. No. 3,979,918, which has provided one solution to the above-mentioned problems.

U.S. Pat. No. 3,979,918 still requires special manufacture of nuts, threads and the like in order to accomplish the desired objective.

It is an object of the present invention to provide a method and tool for practicing the method that is simple, efficient and economical.

It is a further object of the present invention to provide a method and tool for practicing the method that will allow standard threaded rods and nuts to be used when installing chemical anchor bolt assemblies.

It is an object of the present invention to provide a single tool to be used by the operator when installing chemical anchor resin bolt assemblies in earth formations.

BRIEF SUMMARY OF THE INVENTION

According to the present invention, a method for installing chemical anchor bolt assemblies is presented and a tool assembly is described which is especially adapted for practicing the method.

The method of installing and setting chemical anchor bolt assemblies is accomplished by the steps of, first, forming a hole in the earth formation or a mine roof, placing chemical anchor resin in the hole formation, and inserting the chemical anchor bolt including the nut and plate upward in the hole formation until the plate abuts the roof of the mine.

A single tool mounted upon a power driven drilling apparatus is designed such that a part of the tool abuts the end of the rod or bolt protruding from the hole formation with a predetermined force acting toward the hole formation. This force may be on the order of 1,000 to 8,000 pounds.

While this abutment force is maintained upon the end of the chemical anchor bolt assembly, a sleeve of the tool is then used to turn the nut assembly. Turning of the nut while applying sufficient force at the end of the rod will cause the entire anchor bolt to rotate within the hole formation and mix the chemical anchor resin.

After allowing the chemical anchor resin to set and secure the roof bolt at the hole formation, the predetermined force acting on the end of the anchor bolt assembly is removed and the sleeve may then be rotated relative to the bolt to torque the nut to a desired torque level.

The wrench used for practicing the above method comprises a rotatable sleeve having an internal configuration so as to engage and drive the nut in rotation on the rod. Further, a drive member is nonrotatably mounted with the sleeve and, further, is engaged with the sleeve so as to have an axial reciprocal sliding movement with the sleeve. This drive member has opposing ends with one end adapted to slide into and out of abutment with the end of the rod when the sleeve is engaged with the nut and the other end is adapted to be driven in rotation by the power drilling machines usually found in mining operations.

The wrench preferably has a spring acting between the sleeve and the drive member which urges the one abutment end of the drive member into an axially remote position from the part of the sleeve that engages the nut. When the predetermined force is removed from the end of the bolt, the one abutment end of the drive member will move out of abutment and allow the nut to rotate in the bolt. The tool according to the present invention, when installed on an appropriate drilling machine, may be used to raise the chemical anchor bolt assembly into position in the hole formation.

The sleeve portion of the wrench assembly may engage the nut and the one abutment end of the drive member may abut the lower end of the anchor bolt. The drilling machine may then raise the bolt assembly into position in the hole formation. A force of 1,000 to 4,000 pounds is usually then applied on the end of the bolt through the abutting drive member. While such force is being applied, turning of the nut by the sleeve will cause the entire anchor bolt assembly to rotate.

After allowing the resin to set and secure the anchor bolt in the hole formation, the abutment force may be removed and rotation of the tool will cause the nut to rotate relative to the anchor bolt thereby allowing the nut to be torqued to a preset value.

The exact nature of the present invention may become more clearly apparent upon reference to the following detailed specification taken FIG. 4 shows a cut-away view of the tool used to practice the method of the present invention. connection with the accompanying drawings in which:

DETAILED DESCRIPTION OF THE INVENTION

Figure 1:
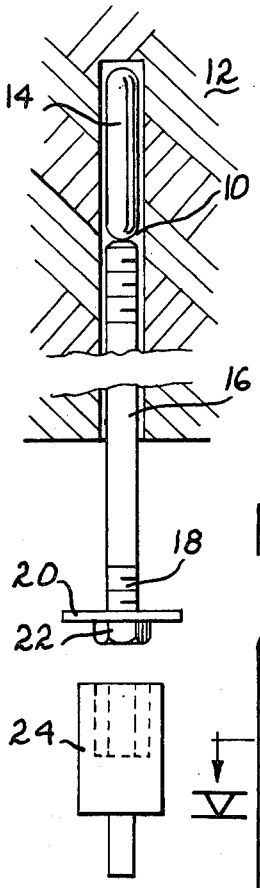
FIGS. 1 and 2 show cut-away views of an anchor bolt assembly being installed in the roof of a mine.
Figure 2:
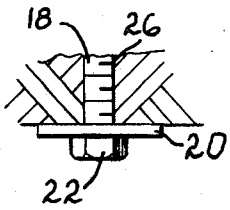

Referring to the drawings somewhat more in detail, what is shown in FIG. 1 is a hole formation 10 which has been formed on the surrounding earth formation 12 which may, for example, be a hole in the roof of a mine. Chemical anchor resin 14 has been placed in hole 10 and an anchor bolt assembly 16 is being inserted upwardly in the hole 10. Anchor bolt assembly 16 consists of an anchor bolt 18 threaded on at least one end and an anchor plate 20 and anchor nut 22 mounted on the lower end of the anchor bolt 18.

A rotary tool 24 is necessary to engage nut 22 and raise the entire chemical anchor bolt assembly 16 into hole 10. As can be seen in FIG. 1, the chemical anchor resin 14 will be ruptured by insertion of the bolt 18, and once the plate 20 abuts the earth formation 12 surrounding the hole 10, it is then necessary to rotate anchor bolt 18 so as to thoroughly mix the resin material 14 in hole 10.

The mixed resin material 26 is then allowed to set until it hardens and firmly secured anchor bolt 18 in hole 10. After the resin has secured the bolt, it is then necessary to torque nut 22 to a predetermined torque level against plate 20 which is resting against the earth formation 12 surrounding hole 10.

As has been mentioned previously, several methods have been tried when installing the chemical anchor bolt assemblies 16. One of the known methods was to provide flats along the length of the chemical anchor bolt 18 such that positive drive tools could be used during installation. One such tool would grip the flats of bolt 18 in order to turn the chemical anchor bolt 18 and mix the resin 14.

After mixing, such a tool could be removed and replaced. The tool such as 24 can then grip nut 22 in order to complete the final torquing step on the roof bolt assemblies. Other methods include providing a square tang, not shown, on the end of the chemical anchor bolt 18 such that a special tool would then be able to engage the square tang and rotate chemical anchor bolt 18. A second tool such as 24 could then be used to torque the nut 22 as has been described previously.

Figure 3:
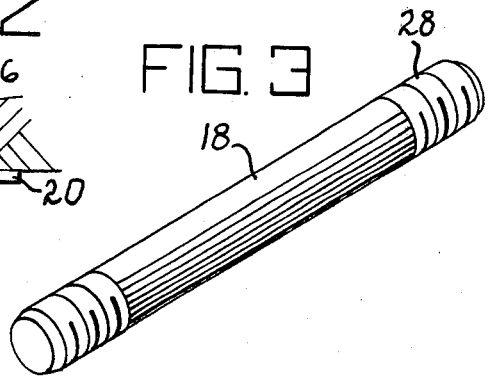
FIG. 3 shows a typical anchor bolt which may be used with the method and apparatus of the present invention.

Referring now to FIG. 3, what is shown is a chemical anchor bolt 18 which preferably has threads 28 on at least one end of a bolt 18. When using the method and apparatus according to the present invention, there need be no special flats or tangs provided with such an anchor bolt 18 but, rather, may be preferably a one inch bar upon which it is only necessary to perform a threading operation before it is ready to be used as an anchor bolt. The bolts generally used in such an operation generally have a rough thread rolled on their entire length so they then need only be cut to the proper length.

Figure 4:
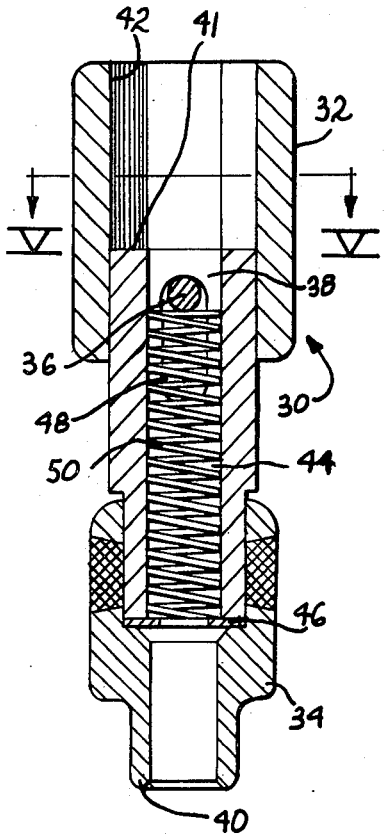
FIG. 4 shows a cut-away view of the tool used to practice the method of the present invention

Referring to FIG. 4, what is shown therein is a wrench assembly 30 according to the present invention which comprises a sleeve 32 connected to a drive member 34. The sleeve 32 is slidably connected to the drive member 34 by pin member 36. Member 34 has opposing ends 38 and 40, with end 38 adapted to have a close nonrotatable sliding fit with the internal configuration of sleeve 32 and, further, the one end 38 has an abutment region 41 thereon which is designed to abut with the lower end of anchor bolt 18.

Sleeve member 32 has an internal configuration 42 which is designed so as to be able to engage and grip nut 22 of the chemical anchor bolt assembly 16. A lower end 40 of drive member 34 is adapted to be driven in rotation by a power driven drilling machine, not shown, normally used in mining operations.

Drive member 34 has a central aperture 44 which terminates toward end 40 in a spring seat 46 which is facing toward sleeve 32. An axial slot 48 is formed along a portion of the length of member 34 and pin member 36 is inserted through sleeve 32 and slot 48 thereby engaging the sleeve 32 with the member 34. Spring 50 is located in the aperture 44 and is compressibly held between the spring seat 46 and the pin member 36.

Figure 5:
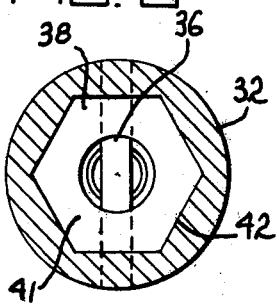
FIG. 5 shows a view through V—V of FIG. 4.

Referring now to FIG. 5, what is shown therein is a sectional view through V—V of FIG. 4. Shown in FIG. 5 is sleeve member 32 having internal configuration 42 which is adapted to engage the outside configuration of nut 22. The abutment end 38 of drive member 34 is shown with its abutment region 41 for abutting one end of chemical anchor bolt assembly 16. The abutment end 38 has an outside configuration which closely mates with the internal configuration 42 of sleeve 32.

This configuration is generally of a noncircular nature and, therefore, the drive member 34 is held in a nonrotatable engagement with sleeve 32. Pin member 36 can be seen in FIG. 5 extending through both sleeve 32 and the abutment end 38 of drive member 34.

Figure 6:
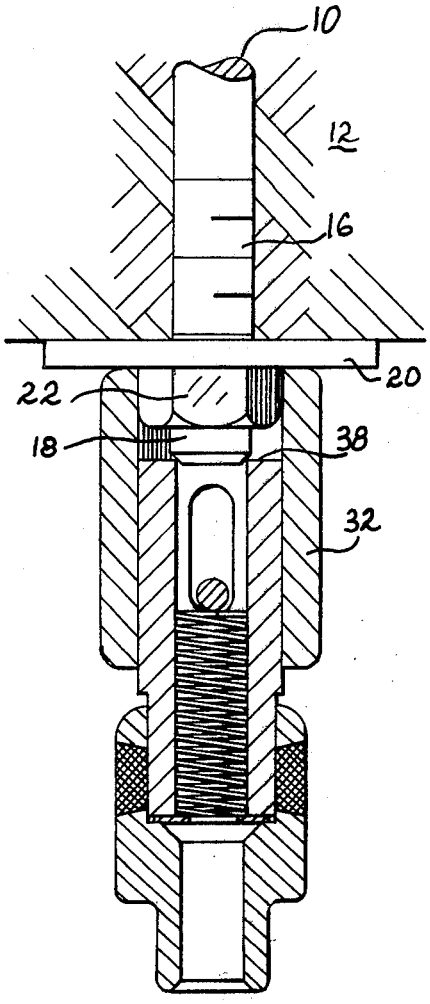
FIGS. 6 and 7 show a cut-away view of an anchor bolt being installed according to the method and apparatus of the present invention.

Referring to FIG. 6, shown therein is earth formation 12 having hole 10 formed therein, with the chemical anchor bolt assembly 16 having been inserted therein. The plate 20 is firmly abutted against earth formation 12 which surrounds hole 10. In FIG. 6, sleeve 32 is engaging nut 22, the abutment end 38 of drive member 34 is solidly abutted against the lower end of anchor bolt 18.

When a predetermined force, in the range of approximately 1,000 to 4,000 pounds, is exerted through abutment end 38 of drive member 34, it can be seen that rotation of the sleeve and drive member will cause the chemical anchor bolt 18 to rotate in hole formation 10. Rotation of bolt 10 causes the chemical anchor resin 14 to be thoroughly mixed.

Figure 7:
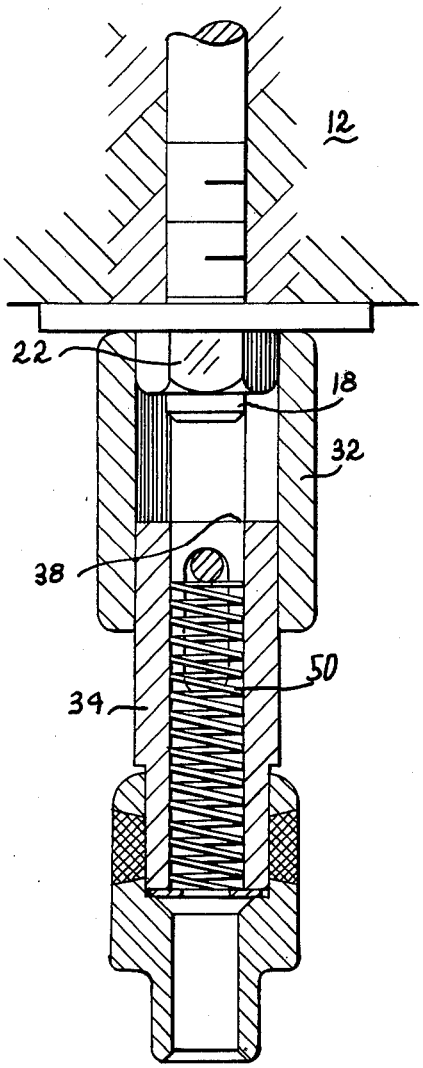

Referring now to FIG. 7, it can be seen that the predetermined force has been removed from drive member 34 and spring 50 has urged drive member 34 such that the abutment end 38 is located in an axially remote position in sleeve 32 from the lower end of chemical anchor bolt 18. Rotation of the sleeve 32 and drive member 34 will now allow relative rotation between nut 22 and chemical anchor bolt 18. It is this relative rotation that allows a desired torque to be placed on nut 22.

Modifications may be made within the scope of the appended claims.

What is claimed is:

1. A wrench for installing anchor bolt assemblies having a rod threaded on at least one end and a nut on the threaded end of the rod, said wrench comprising; a rotatable sleeve having a configuration so as to engage and drive the nut in rotation on the rod, a member nonrotatably mounted with said sleeve and engaged with said sleeve so as to have an axial reciprocal sliding movement with said sleeve, said member having opposing ends with one end adapted to abut the axial end of the rod and the other end of said member adapted to be driven in rotation, and means urging said one end of said member into an axially remote position from the part of the sleeve that engages the nut.

2. A wrench according to claim 1 in which said means comprises spring means urging said one end of said member into an axially remote position from the part of the sleeve that engages the nut.

3. A wrench according to claim 2 in which said one end of said member has a close slidable fit inside said sleeve member.

4. A wrench according to claim 3 in which said member has a slot formed transversely therethrough extending axially toward said one end of said member and a pin element extends transversely through said slot and said sleeve nonrotatably joining said member with said sleeve.

5. A wrench according to claim 4 in which said member has a central aperture terminating on one end with a spring seat facing said sleeve and extending in the other end part of the slot and a spring located in said aperture and compressively held between said spring seat and said pin.

6. The method of installing and setting chemical anchor bolt assemblies having a rod threaded at one end and a nut on the threaded end of the rod, said method comprising the steps of; forming a hole in an earth formation, placing chemical anchor resin in the hole formation, inserting the end of the threaded rod opposite the end with the nut into the hole, operatively abutting the anchor bolt assembly against the earth formation surrounding the hole, abutting the axial end of the rod protruding from the hole formation with a predetermined force acting toward the hole formation, turning the nut while applying sufficient force on the end of the rod to cause the rod to rotate with the nut and thereby mix the chemical anchor resin in the hole, and allowing the chemical anchor resin to set and secure the roof bolt in the hole formation.

7. The method according to claim 6 which further comprises removing said predetermined force from the rod after the resin has set and torquing the nut to a desired torque value.

* * * * *